US005232163A

United States Patent [19]

Grytz

[11] Patent Number: 5,232,163

[45] Date of Patent: Aug. 3, 1993

[54] APPARATUS FOR INJECTING A FUEL/GAS MIXTURE

[75] Inventor: Uwe Grytz, Bamberg, Fed. Rep. of Germany

[73] Assignee: Robert Bosch GmbH, Stuttgart, Fed. Rep. of Germany

[21] Appl. No.: 786,671

[22] Filed: Nov. 1, 1991

[30] Foreign Application Priority Data

Nov. 7, 1990 [DE] Fed. Rep. of Germany ..... 4035312

[51] Int. Cl.[5] ..... B05B 7/10; F02M 23/00

[52] U.S. Cl. ..... 239/405; 239/403; 239/424.5; 239/533.12; 239/585.1

[58] Field of Search ..... 239/401, 403, 405, 410, 239/412, 416.5, 533.12, 585.1, 419.5, 424.5, 429

[56] References Cited

U.S. PATENT DOCUMENTS

| | | | |
|---|---|---|---|
| 2,551,276 | 5/1951 | McMahan | 239/403 |
| 3,029,029 | 4/1962 | Webster | 239/416.5 |
| 3,084,875 | 4/1963 | Klingler | 239/429 |
| 3,362,647 | 1/1968 | Davis, Sr. et al. | 239/419.5 |
| 3,656,693 | 4/1972 | Eckert | 239/410 |
| 4,434,766 | 3/1984 | Matsuoka et al. | 239/405 |
| 4,566,634 | 1/1986 | Wiegand | 239/410 |
| 5,035,358 | 7/1991 | Katsuno et al. | 239/429 |
| 5,129,381 | 7/1992 | Nakajima | 239/533.12 |

FOREIGN PATENT DOCUMENTS

| | | | |
|---|---|---|---|
| 3609798 | 10/1986 | Fed. Rep. of Germany . | |
| 1496800 | 8/1967 | France | 239/410 |
| 168472 | 9/1921 | United Kingdom | 239/406 |

*Primary Examiner*—Andres Kashnikow
*Assistant Examiner*—Christopher G. Trainor
*Attorney, Agent, or Firm*—Edwin E. Greigg; Ronald E. Greigg

[57] ABSTRACT

In known equipment for injecting a fuel/gas mixture, having a fuel injection valve protruding into a stepped longitudinal bore of a gas distributor part, the formation of as homogeneous as possible a fuel/gas mixture and the fine atomization of the fuel are not assured if the gas envelops the injected fuel approximately in the flow direction of the fuel. The novel apparatus has a swirl element in the longitudinal opening of the gas distributor part, the swirl element having a mixing opening extending concentrically with the longitudinal valve axis; at least one curved, groovelike flow conduit, formed in the wall of the swirl element, discharges into this mixing opening. As a result, particularly fine atomization of the fuel and the formation of the most homogeneous possible fuel/gas mixture are assured. The embodiment of the apparatus is especially suitable for use in mixture-compressing internal combustion engines with externally supplied ignition.

14 Claims, 1 Drawing Sheet

APPARATUS FOR INJECTING A FUEL/GAS MIXTURE

BACKGROUND OF THE INVENTION

The invention is directed to an improved apparatus for injecting a fuel/gas mixture in an internal combustion engine.

An apparatus for injecting a fuel/gas mixture is already known from German patent application No. 36 09 798 Al, in which the fuel injection valve protrudes by its valve end into a stepped longitudinal bore of a gas distributor part. The gas therein envelops the injected fuel in its flow direction and leads to the formation of a fuel/gas mixture. However, this apparatus has the disadvantage that because of the uniform flow of gas extending approximately in the direction of the injected fuel, only an inadequate turbulence is created in the fuel, so that a relatively nonhomogeneous fuel/gas mixture is formed, resulting in a relatively large fuel droplet size. For the sake of both exhaust emissions and fuel consumption, however, it is desirable to make the fuel intensively turbulent, thus producing fine droplets of fuel.

OBJECTS AND SUMMARY OF THE INVENTION

It is a principal object of the apparatus according to the invention to provide the advantage that as the gas emerges from the at least one curved flow conduit into the mixing opening of the swirl element, it meets the injected fuel already in a swirling form. As a rule, the fuel is made particularly intensively turbulent and is finely atomized, so that a very homogeneous fuel/gas mixture forms. A homogeneous fuel/gas mixture assures low exhaust emissions, good acceleration performance, and low fuel consumption on the part of the internal combustion engine.

It is another object of the invention to provide an apparatus having a simple mechanical structure that can be manufactured simply and economically.

It is still another object of the invention and particularly advantageous for the at least one flow conduit of the swirl element to have a helical curvature, and for its cross-sectional area to narrow toward the mixing opening. The gas flowing into the mixing opening then has a pronounced swirl and a high flow velocity.

It is yet another object of the invention to provide, in order for the gas upon flowing into the mixing opening to strike the injected fuel directly, that the at least one flow conduit discharges radially into the mixing opening.

Another object of the invention provides the advantage that the gas delivery conduit communicates with the longitudinal opening of the gas distributor part at a tangent, so that the delivered gas flows swirlingly into the longitudinal opening and into the flow conduits of the swirl element.

In still another object of the invention, it is advantageous if a compression spring is disposed between a downstream retaining shoulder of the longitudinal opening of the gas distributor part and an end face, remote from the end of the fuel injection valve, of the swirl element that is axially displaceable. The compression spring not only enables axial compensation for positional tolerances between the fuel injection valve and the gas distributor part or its longitudinal opening, but also makes for a uniform pressure on the swirl element as it is pressed against the fuel injection valve.

In yet an additional object of the invention, it is advantageous if the swirl element is secured against torsion relative to the longitudinal bore of the gas distributor part so that the gas flowing through the swirl element cannot twist the swirl element; this assures exact positioning of the exit location of the gas. When two-stream fuel injection valves are used, for instance for four-valve internal combustion engines, this feature is especially important.

In yet another object of the invention, it is advantageous if a retaining protrusion that cooperates with a recess formed in the wall of the longitudinal opening of the gas distributor part is formed on the circumference of the swirl element.

In still a further object of the invention, it is especially advantageous if a plurality of stepped longitudinal openings, each having one swirl element, are formed in the gas distributor part and communicate with a common gas delivery conduit; this makes for a compact unit that can be manufactured economically.

In still another object of the invention, it is advantageous if the gas distributor part, which has a plurality of longitudinal bores, can be made to communicate with a fuel distributor part that serves to deliver fuel and receives fuel injection valves which correspond in number to the number of longitudinal openings of the gas distributor part and are arranged concentrically with these openings.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
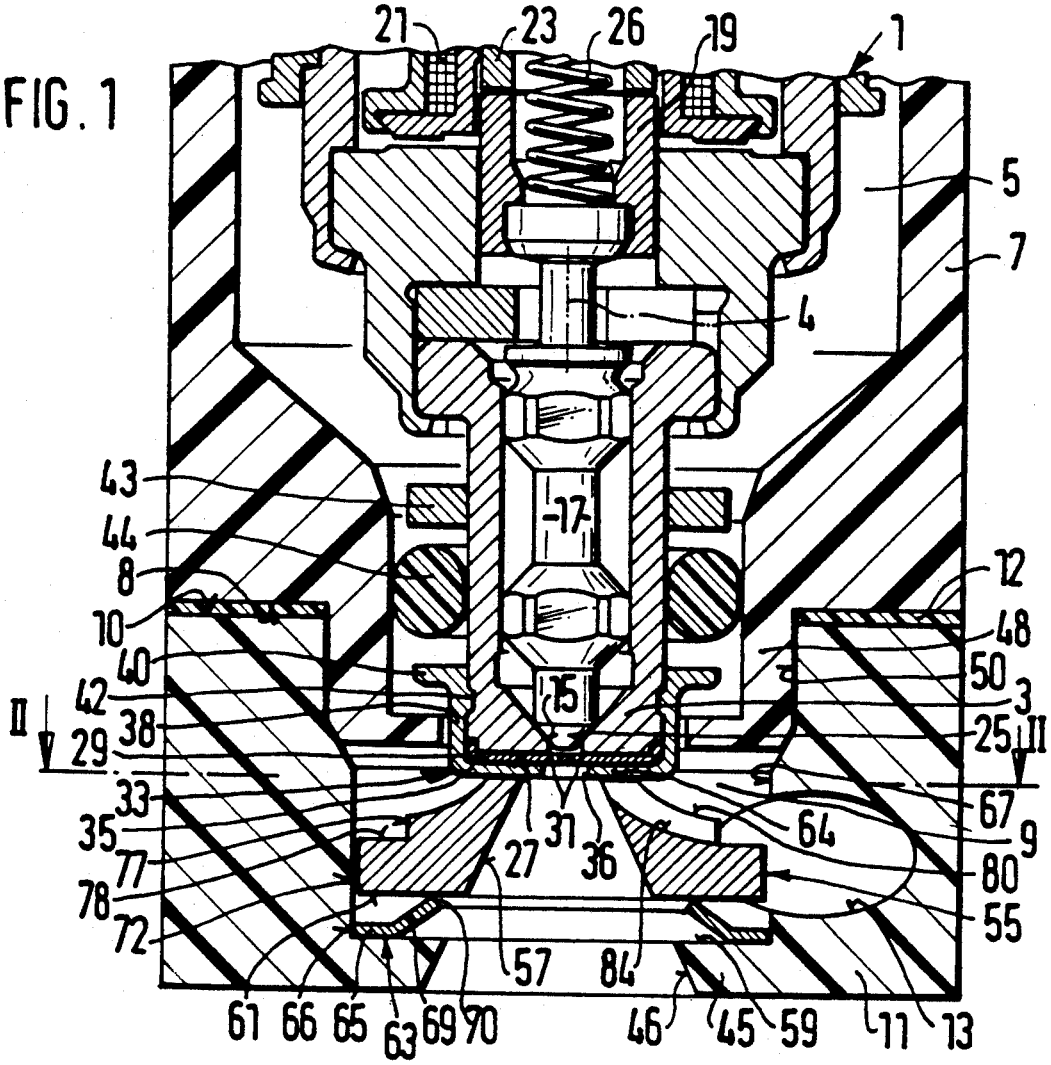
FIG. 1 shows an exemplary embodiment of the invention with a fuel injection valve shown in fragmentary form along with a fuel distributor part, also shown in fragmentary form.

The apparatus shown by way of example in FIG. 1 for injecting a fuel/gas mixture into an intake manifold or directly into a combustion chamber of a mixture-compressing internal combustion engine with externally supplied ignition has a fuel injection valve I with a valve end 3. The fuel injection valve 1 is partly surrounded in the axial direction by a stepped receiving bore 5 that extends concentrically with a longitudinal valve axis 4 in a fuel distributor part 7; for instance, this part 7 has a number of stepped receiving openings 5 matching the number of cylinders of the engine. The fuel injection valve 1 protrudes by its end 3 into a stepped longitudinal opening, extending concentrically with respect to the longitudinal axis 4 of the valve, of a gas distributor part 11, for instance formed as a plastic injection molded part. The gas distributor part 11 has a number of longitudinal openings 9, for instance corresponding to the number of engine cylinders, and can be connected to the fuel distributor part 7. The stepped longitudinal openings 9 are arranged in the gas distributor part 11 such that they extend concentrically with the receiving openings 5 of the fuel distributor element 7, once the fuel distributor element 7 and gas distributor part 11 are joined together, as shown in FIG. 1.

A flat seal 12 is disposed between a end face 10 of the gas distributor part 11 oriented toward the fuel distributor part 7 and an opposed stop face 8 of the fuel distributor part 7. One gas delivery conduit 13, for instance, is formed in the gas distributor part 11, communicating at a tangent with the various longitudinal openings 9 of the gas distributor part 11. In this way the delivered gas is already swirling as it arrives in the longitudinal openings 9.

At one end 3, the fuel injection valve 1 has one valve closing element 17, for instance, cooperating with a fixed valve seat 15 narrowing frustroconically in the direction of fuel flow. On its opposite end, remote from the fixed valve seat 15, the valve closing element 17 is joined to an armature 19, which cooperates with a magnet coil 21 partly surrounding the armature 19 in the axial direction and a core 23 opposite the armature 19 in the direction remote from the fixed valve seat 15. A sealing segment 25 of the valve closing element 17 cooperates with the fixed valve seat 15 and is frustroconical, for example. A restoring spring 26 that tends to move the valve closing element 17 toward the fixed valve seat 15 rests on the end of the valve closing element 17 joined to the armature 19.

A small perforated plate 29 rests directly on one end face 27 of the valve end 3. The perforated plate 29 has injection ports 31, for example two in number, through which the fuel flowing past the fixed valve seat 15 when the valve closing element 17 is raised from its seat is ejected.

A cup-shaped protective cap 33 can be disposed on the end 3 of the fuel injection valve 1, resting with a bottom portion 35 on the perforated plate 29. The bottom portion 35 has a flow opening 36, through which the fuel flowing out of the injection ports 31 is ejected. In the direction toward the magnet coil 21, the bottom portion 35 of the protective cap 33 is adjoined first by an axially extending parallel segment 38 and then by a radially outwardly protruding lip segment 40. The protective cap 33 is joined to the circumference of the valve end 3 by a detent connection 42.

A retaining ring 43 is disposed about the circumference of the end 3 of the fuel injection valve 1. A sealing ring 44 is disposed radially of the valve engaging the circumference of the valve end 3 and the wall of the receiving opening 5 of the fuel distributor part 7. The axial displaceability of the sealing ring 44 on the circumference of the valve end 3 is limited both by the radial lip segment 40 of the protective cap 33 and by the retaining ring 43, so that a secure, reliable seal between the valve end 3 and receiving opening 5 of the fuel distributor part 7 is assured.

On their end remote from the fuel distributor part 7, the longitudinal openings 9 of the gas distributor part 11 have a retaining shoulder 45 pointing radially inward and defining an outflow segment 46, concentric with the longitudinal valve axis 4, that widens, for instance frustroconically, remote from the fuel injection valve 1. With a centering element 48 oriented toward the retaining shoulder 45 of the gas distributor part 11, the fuel distributor part 7 protrudes with little radial play into a centering segment 50 of the longitudinal opening 9 of the gas distributor part 11, so that the receiving opening 5 of the fuel distributor part 7 and the fuel injection valve 1 disposed in it are centered relative to the longitudinal opening 9 of the gas distributor part 11.

A swirl element 55 is disposed in the longitudinal opening in the axial direction between the end 3 of the fuel injection valve 1 and the retaining shoulder 45 of the gas distributor part 11. Concentric with the longitudinal valve axis 4, the swirl element 55 has a continuous mixing opening 57 that widens frustroconically in the flow direction toward the retaining shoulder 45; the swirl element is displaceable in the axial direction, because of the disposition of a compression spring 63, which is in the form of a cup spring, for instance, and as a mass-produced product can be obtained inexpensively, between a retaining face 59 of the retaining shoulder 45 oriented toward the swirl element 55 and a end face 61 of the swirl element 55 oriented toward the retaining shoulder 45. The compression spring 63 rests with an outer radial segment 65 axially on the retaining face 59 of the retaining shoulder 45 and radially, by its circumference formed by the outer rim of the radial segment 65, on a parallel wall segment 67 of the longitudinal opening 9 of the gas distributor part 11. By its end 70 oriented axially toward the fuel injection valve 1, an inclined, radially inwardly pointing segment 69 of the compression spring 63 rests on the end face 61 of the swirl element 55. When the apparatus according to the invention has been installed, the compression spring 63 is elastically deformed axially, or in other words prestressed, so that the compression spring 63 presses the axially displaceable swirl element 55, by its end face 64, toward the protective cap 33, against the bottom portion 35 of the protective cap 33 secured to the end 3 of the fuel injection valve 1. In this way the compression spring 63 enables axial compensation for the positional tolerances of the fuel injection valve 1 and the gas distributor part 11 or its longitudinal opening 9. It is sufficient for the compression spring 63 to have only a relatively low spring constant, thereby averting the danger of damage to the swirl element 55, which for instance is embodied as a plastic injection molded part.

On its circumference, adjacent the compression spring 63, the swirl element 55 has a first cylindrical segment 72, the diameter of which is slightly smaller than the diameter of the parallel wall segment 67 of the longitudinal opening 9 surrounding the swirl element 55, so that a narrow radial gap is formed between the first cylindrical segment 72 of the swirl element 5 and the longitudinal opening 9 of the ga distributor part 11. As a result, and because of the axial contact of the compression spring 63 with the end face 61 of the swirl element 55 and with the retaining face 59 of the retaining shoulder 45, as well as the radial contact of the compression spring on the parallel wall segment 67 of the longitudinal opening 9, a flow of gas past the circumference of the swirl element 55 as far as the outflow segment 46 of the retaining shoulder 45 is prevented.

Figure 2:
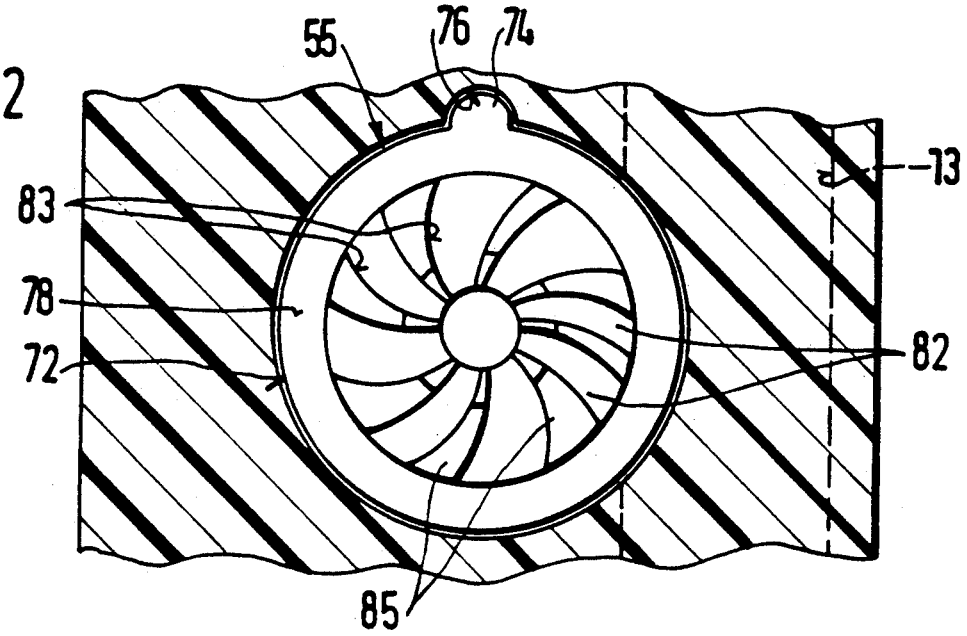
FIG. 2 is a section taken along the line II—II of FIG. 1.

As shown in FIG. 2, a retaining protrusion 74 is formed on the circumference of the first cylindrical segment 72 of the swirl element 55 to extend axially over the entire length, for instance, of the first cylindrical segment 72. A complemental recess 76 is formed in the wall of the parallel wall segment 67 of the longitudinal bore 9 and cooperates with the retaining protrusion 74 of the swirl element 55 in such a way that the retaining protrusion 74 protrudes into the recess 76 of the longitudinal bore 9 of the gas distributor part 11, so that the swirl element 55 is secured against torsion relative to the longitudinal bore 9. This arrangement assures that the gas will exit at a defined location, which is important if multi-stream injection valves are used, for instance for four-valve internal combustion engines.

The first cylindrical segment 72 is adjoined by a plane radial segment 78 of the swirl element 55, which on its end toward the valve end 3 is oriented radially inward and extends to a second cylindrical segment 77. Extending in the axial direction, a flow segment 80 narrowing toward the longitudinal valve axis 4 is formed in the axial direction between the second cylindrical segment 77 and the end face 64 of the swirl element 55 that rests on the protective cap 33. The flow segment 80 is defined so as to be concave in shape, for instance, on its circumference; in other words it is recessed so that it curves radially outward away from the valve end 3. Referring again to FIG. 2, at least one flow conduit 82, but in the exemplary embodiment shown a plurality of flow conduits 82, is formed in the wall of the flow segment 80 of the swirl element 55. These flow conduits take the form of grooves 83 extending for instance up to the inside of the second cylindrical segment 77; from the second cylindrical segment 77, they extend with a helical curvature as far as the end face 64 of the swirl element 55, and there, as shown in FIG. 2 in a section taken along the line II—II of FIG. 1, they discharge radially into the mixing opening 57 of the swirl element 55. The flow conduits 82 are embodied such that the flow cross sections narrow or taper continuously in the direction of the end face 64 to the mixing opening 57 of the swirl element 55. The flow conduits 82 are laterally defined by flow vanes 85, which serve to guide the gas flowing in the direction of the mixing opening 57. As a result of the narrowing flow cross section, the gas is accelerated sharply, and it attains its maximum velocity upon exiting from the flow conduits 82. The flow conduits 82, or the grooves 83 forming them, have the same axial length, for instance, on their groove bottoms 84 as the second cylindrical segment 77 of the swirl element 55, as shown in FIG. 1. The bottom walls of the grooves 84 extend with the same concave curvature as the circumference of the flow segment 80 in the direction of the end face 64 of the swirl element 55.

The quantity of gas delivered to the mixing opening 57 of the swirl element 55 is determined by the size of the flow cross sections of the flow conduits 82. Radially delivering the gas at high velocity through the mixing opening 57 to the fuel dispensed from the injection ports 31 leads to the formation of the most homogeneous possible fuel/gas mixture, with especially fine fuel droplets. As a result, during engine operation, substantial improvements can be attained in terms of exhaust emissions, acceleration performance, and fuel consumption.

As the gas for forming the fuel/gas mixture, both fresh air and an inert gas, or a mixture of the two, may be used. Fresh air is for instance diverted from the intake manifold upstream of an arbitrarily adjustable throttle device and delivered to the gas delivery conduit 13. For the inert gas, the exhaust gas of the engine can for instance be used, so that with this exhaust gas recirculation, the toxic emissions from the engine are reduced. Alternatively, the gas can be pumped by a supplementary pump.

The apparatus according to the invention also has the advantage of simple structure and low manufacturing costs. A system unit comprising the fuel distributor part 7, fuel injection valves 1, gas distributor part 11 having the swirl elements 55, and a pressure regulator for the fuel can be mounted simply and therefore economically on the intake line of an internal combustion engine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for injecting a fuel/gas mixture, having a fuel injection valve that has at least one injection port on one end of the valve, said apparatus further having a gas distributor part (11) disposed adjacent said one end of said valve and provided with at least one stepped longitudinal opening (9) extending concentrically with a longitudinal axis of the valve, said valve being arranged to protrude by said one end into said stepped longitudinal opening, said gas distributer part further having a gas delivery conduit (13) communicating with the stepped longitudinal opening of the gas distributor part, a swirl element (55) disposed downstream of said one end of the fuel injection valve int he longitudinal opening of the gas distributor part, said swirl element having an end face (64) and a mixing opening (57) extending concentrically with a longitudinal axis (4) of said valve, and at least one curved, groovelike flow conduit (82) is formed in said swirl element being open in the radial direction to the circumference of said swirl element and opened toward said end face (64), said flow conduit communicating with the gas delivery conduit and discharging into the mixing opening (57) of the swirl element (55).

2. An apparatus as defined by claim 1, in which the at least one flow conduit (82) of the swirl element (55) extends radially inward and is provided with a helical curvature, and its flow cross-sectional area narrows continuously in the direction of the mixing opening (57).

3. An apparatus as defined by claim 1, in which the at least one flow conduit (82) discharges radially into the mixing opening (57) of the swirl element (55).

4. An apparatus as defined by claim 2, in which the at least on flow conduit (82) discharges radially into the mixing opening (57) of the swirl element (55).

5. The apparatus as defined by claim 1, in which the gas delivery conduit (13) communicates tangentially with the longitudinal opening (9) of the gas distributor part (11).

6. The apparatus as defined by claim 2, in which the gas delivery conduit (13) communicates tangentially with the longitudinal opening (9) of the gas distributor part (11).

7. An apparatus as defined by claim 1, in which a compression spring (63) is disposed between a downstream retaining shoulder (45) of the longitudinal opening (9) of the gas distributor part (11) and an end face (61) of the swirl element (55) remote from the one end (3) of the fuel injection valve (1).

8. The apparatus as defined by claim 7, in which the compression spring (63) comprises a cup spring.

9. The apparatus as defined by claim 1, in which the swirl element (55) is secured against torsion relative to the longitudinal opening (9) of the gas distributor part (11).

10. The apparatus as defined by claim 9, in which a protrusion (74) is formed on the circumference of the swirl element (55) to cooperate with a complemental recess (76) formed in a wall of the longitudinal opening (9) of the gas distributor part (11) to retain the swirl element in place.

11. An apparatus as defined by claim 1, in which said at least one stepped longitudinal opening (9) comprises a plurality thereof formed in the gas distributor part (11), each said opening having one swirl element (55) and being arranged to communicate with said gas delivery conduit (13).

12. An apparatus as defined by claim 11, in which the gas distributor part (11) is adapted for connection to a fuel distributor part (7) provided with a plurality of fuel injection valves (1) corresponding to the number of stepped longitudinal openings (9) disposed in the ga distributor part (11), said valves are disposed concentrically with respect to these openings, and the fuel distributor part serves to deliver fuel.

13. An apparatus as defined by claim 11, in which a fuel/gas injection system, comprising the fuel distributor part (7), the fuel injection valves (1), the gas distributor part (11) provided with the swirl elements (55) disposed in it, and a pressure regulator installed as a combined unit on an intake line of an internal combustion engine.

14. An apparatus as defined by claim 12, in which a fuel/gas injection system, comprising the fuel distributor part (7), the fuel injection valves (1), the gas distributor part (11) provided with the swirl elements (55) disposed in it pressure regulator, can be installed as a combined unit on an intake line of an internal combustion engine.

* * * * *